US010897948B2

(12) United States Patent
Donaldson

(10) Patent No.: US 10,897,948 B2
(45) **Date of Patent: *Jan. 26, 2021**

(54) FOOTWEAR ROOFING SHOES

(71) Applicant: Ben Donaldson, New Lambton (AU)

(72) Inventor: Ben Donaldson, New Lambton (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/330,109

(22) Filed: Aug. 9, 2016

(65) Prior Publication Data

US 2018/0055135 A1 Mar. 1, 2018

(51) Int. Cl.

| | |
|---|---|
| ***A41B 1/00*** | (2006.01) |
| ***A43B 1/00*** | (2006.01) |
| ***A43B 13/10*** | (2006.01) |
| ***A47L 23/04*** | (2006.01) |
| ***A43B 13/24*** | (2006.01) |
| ***A43B 13/12*** | (2006.01) |
| ***A43B 7/32*** | (2006.01) |

(52) U.S. Cl.

CPC ..... *A43B 1/0054* (2013.01); *A43B 7/32* (2013.01); *A43B 13/10* (2013.01); *A43B 13/125* (2013.01); *A43B 13/24* (2013.01); *A47L 23/04* (2013.01)

(58) Field of Classification Search

CPC ..... A43B 1/0054; A43B 13/24; A43B 13/22; A47L 23/04; A41B 1/10; A63C 10/10

USPC ..... 36/59 R, 127, 113; 280/87.042; 414/800

See application file for complete search history.

(56) References Cited

U.S. PATENT DOCUMENTS

| | | | | |
|---|---|---|---|---|
| 4,105,239 | A * | 8/1978 | Akczinski, Sr. | A47L 13/41 294/65.5 |
| 5,473,963 | A | 12/1995 | Aeschbach | |
| 5,704,256 | A | 1/1998 | De Lattre | |
| 5,769,438 | A * | 6/1998 | Svetlov | A63C 17/01 280/87.041 |
| 6,405,456 | B1 * | 6/2002 | Nichelson | A43B 1/0054 36/27 |
| 7,837,218 | B2 | 11/2010 | Flaig | |
| 8,371,046 | B2 | 2/2013 | Yanke et al. | |
| 2003/0075890 | A1 * | 4/2003 | Jacobs | A63C 10/02 280/87.042 |
| 2003/0211789 | A1 * | 11/2003 | Taylor | B63B 35/7936 441/74 |
| 2003/0224676 | A1 * | 12/2003 | Takahashi | A43B 1/0054 441/74 |

(Continued)

FOREIGN PATENT DOCUMENTS

| | | | |
|---|---|---|---|
| CN | 2745393 | Y | 12/2005 |
| KR | 1020080016919 | A1 | 2/2008 |

(Continued)

OTHER PUBLICATIONS

Office Action dated Mar. 2, 2017 from U.S. Appl. No. 14/392,049, filed Aug. 7, 2015.

(Continued)

*Primary Examiner* — Jillian K Pierorazio

(74) *Attorney, Agent, or Firm* — David B. Tingey; Bryant J. Keller; Kirton McConkie

(57) ABSTRACT

Footwear having a vamp, an insole, a midsole and an outsole, wherein a plurality of spaced apart magnets are located adjacent said outsole so that in use said magnets provide a gripping force between said footwear and a ferrous metallic surface upon which said footwear is placed.

20 Claims, 10 Drawing Sheets

(56) References Cited

U.S. PATENT DOCUMENTS

2006/0197311 A1* 9/2006 Flaig ..... A63C 10/10 280/611
2008/0078698 A1* 4/2008 Lin ..... A47L 13/41 209/215
2008/0172909 A1* 7/2008 Banks ..... A43B 1/0054 36/136
2009/0229146 A1* 9/2009 Yanke ..... A43B 1/0054 36/131
2009/0288316 A1 11/2009 Fullerton et al.
2010/0025967 A1* 2/2010 Flaig ..... A63C 5/128 280/612
2010/0175353 A1* 7/2010 Der ..... A43B 1/0054 54/49
2010/0237599 A1* 9/2010 Bianchi ..... A43B 1/0054 280/841
2011/0219911 A1* 9/2011 Zoumaras ..... B62J 25/00 74/594.6
2011/0302811 A1* 12/2011 Chang ..... A43B 1/0054 36/131
2012/0180344 A1* 7/2012 Crowley, II ..... A43B 1/0009 36/32 R
2013/0192178 A1* 8/2013 Yanke ..... B68C 3/00 54/47
2014/0215860 A1* 8/2014 Moorman ..... A43B 1/0054 36/25 R

FOREIGN PATENT DOCUMENTS

SU 1743554 A1 6/1992
WO 2008/018733 A1 2/2008

OTHER PUBLICATIONS

Office Action dated Nov. 30, 2017 from U.S. Appl. No. 14/392,049, filed Aug. 7, 2015.
International Search Report dated Sep. 7, 2009 from International Patent Application No. PCT/AU2009/001039, filed Aug. 13, 2009.
International Preliminary Report on Patentability dated Feb. 15, 2011 from International Patent Application No. PCT/AU2009/001039, filed Aug. 13, 2009.
Office action dated Sep. 8, 2016 from Australian Patent Application No. 2009281707, filed Aug. 13, 2009.
Office action dated Mar. 1, 2017 from Australian Patent Application No. 2009281707, filed Aug. 13, 2009.
Notice of Allowance dated Jun. 18, 2018 from U.S. Appl. No. 14/392,049 filed Aug. 7, 2015.

* cited by examiner

FOOTWEAR ROOFING SHOES

TECHNICAL FIELD

The present invention relates to footwear and, in particular to, a shoe having magnets located in the sole for attachment to a metal surface.

BACKGROUND OF THE INVENTION

Typical footwear includes a vamp or upper that holds the shoe onto the foot of a user and a sole which cushions the impact of a user on a surface. The sole includes an insole which is the interior bottom of a shoe which contacts the user's foot in use and an outsole which is in direct contact with a surface. The midsole is the layer between the insole and the outsole and typically includes shock absorbent material or the like.

Footwear designed specifically for a work environment has increased greatly and now includes features such as a steel cap front portion and/or the vamp being oil, heat or grease resistant, for example. Further, there are many different types of outsoles. For example, hiking boots have a very pronounced grip tread, shoes for ice and rain have been developed and athletic shoes have ranges of outsoles for particular sports.

In the construction industry, many workers climb on scaffolding, structures, roofs or the like and require substantial dexterity not to fall. Many of the roof surfaces can be slippery with little grip being provided. Safety harnesses and barriers have been developed to prevent a workman falling. However, little consideration has been given to the workman's shoes.

Accordingly, there is a need for footwear that provides a user increased grip on a work surface such as a roof and in particular to a roof made of metallic materials.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present invention provides footwear having:

a vamp;

an insole;

a midsole; and an outsole; a plurality of spaced apart magnets located adjacent said outsole so that in use said magnets provide a gripping force between said footwear and a ferrous metallic surface upon which said footwear is placed.

The magnets are preferably embedded in said midsole.

The midsole preferably includes a first surface adjacent said insole and a second surface adjacent said outsole, and a plurality of apertures to receive said magnets extending inwardly from said second surface towards said first surface.

The magnets are preferably circular had have a diameter of between about 30 mm and 45 mm.

Preferably a first magnet is positioned adjacent to a wearer's heel bone, a second magnet is positioned adjacent to where a wearer's proximal phalanx meets the middle phalanx, a third magnet is positioned between the first and second magnets, and a fourth magnet is positioned adjacent to a wearer's toes.

The footwear further preferably comprises a fifth magnet adjacent to the fourth magnet, such that the fourth and fifth magnets are located adjacent to a wearer's toes.

The first, second and third magnets preferably have centre points which are located on a common line.

The magnets are each preferably housed in a ferrous metal housing having a planar base and a cylindrical wall portion defining a receptacle.

Preferably an exposed surface of each magnet is generally in alignment with the end portion of the cylindrical wall portion.

The footwear preferably further comprises a cleaning tool, the cleaning tool having a handle connected to a cup, the cup holding a cleaning tool magnet having a polarity which is opposed to the polarity of each magnet on the underside of the outsole, such that the cleaning tool is attracted to each magnet of the footwear.

The thickness of the outsole rubber is preferably between about 1 mm and 3 mm, and the thickness of the pattern of the rubber is between 1 mm and 3 mm, such that the total thickness of the outsole is between about 2 mm and 6 mm.

BRIEF DESCRIPTION OF THE DRAWINGS

A preferred embodiment of the invention will now be described by way of specific example with reference to the accompanying drawings, in which:

FIG. 3 depicts a side view of the footwear sole of FIG. 3A, taken along line A-A;

FIG. 6D shows magnets being assembled in a sole with either a positive or negative force facing out towards the metallic surface the footwear will be in contact with; and FIG. 7 shows magnets being assembled in the sole with either a positive or negative force facing out towards the metallic surface the footwear will be in contact with.

DETAILED DESCRIPTION OF THE PREFERRED EMBODIMENTS

Figure 1:
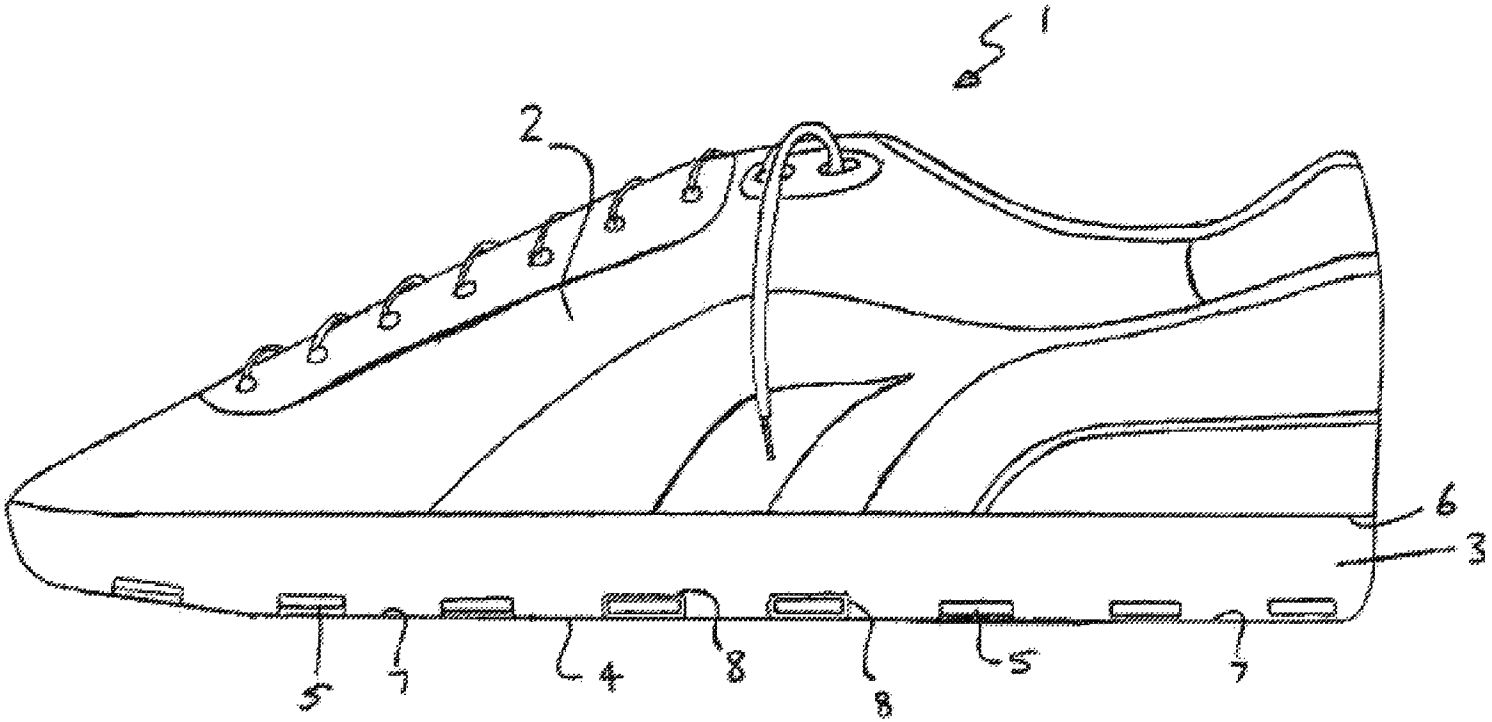
FIG. 1 is a side view of an item of footwear according to a first embodiment of the invention.

According to a first embodiment, there is schematically depicted in the drawings, footwear 1 having a vamp 2, an insole, a midsole 3 and an outsole 4. A plurality of spaced apart magnets 5 are located adjacent the outsole 4 so that in use the magnets 5 provide a gripping force between the footwear 1 and a metallic surface (not shown) upon which the footwear 1 is placed. Preferably, the magnets 5 are located in the midsole 3.

The surface could for example be a metal roof however the invention should not be limited to this use only. The midsole 3 includes a first surface 6 adjacent the insole and a second surface 7 adjacent the outsole 4. A plurality of apertures 8 receive the magnets 5 and extend inwardly from the second surface 7.

Figure 2:
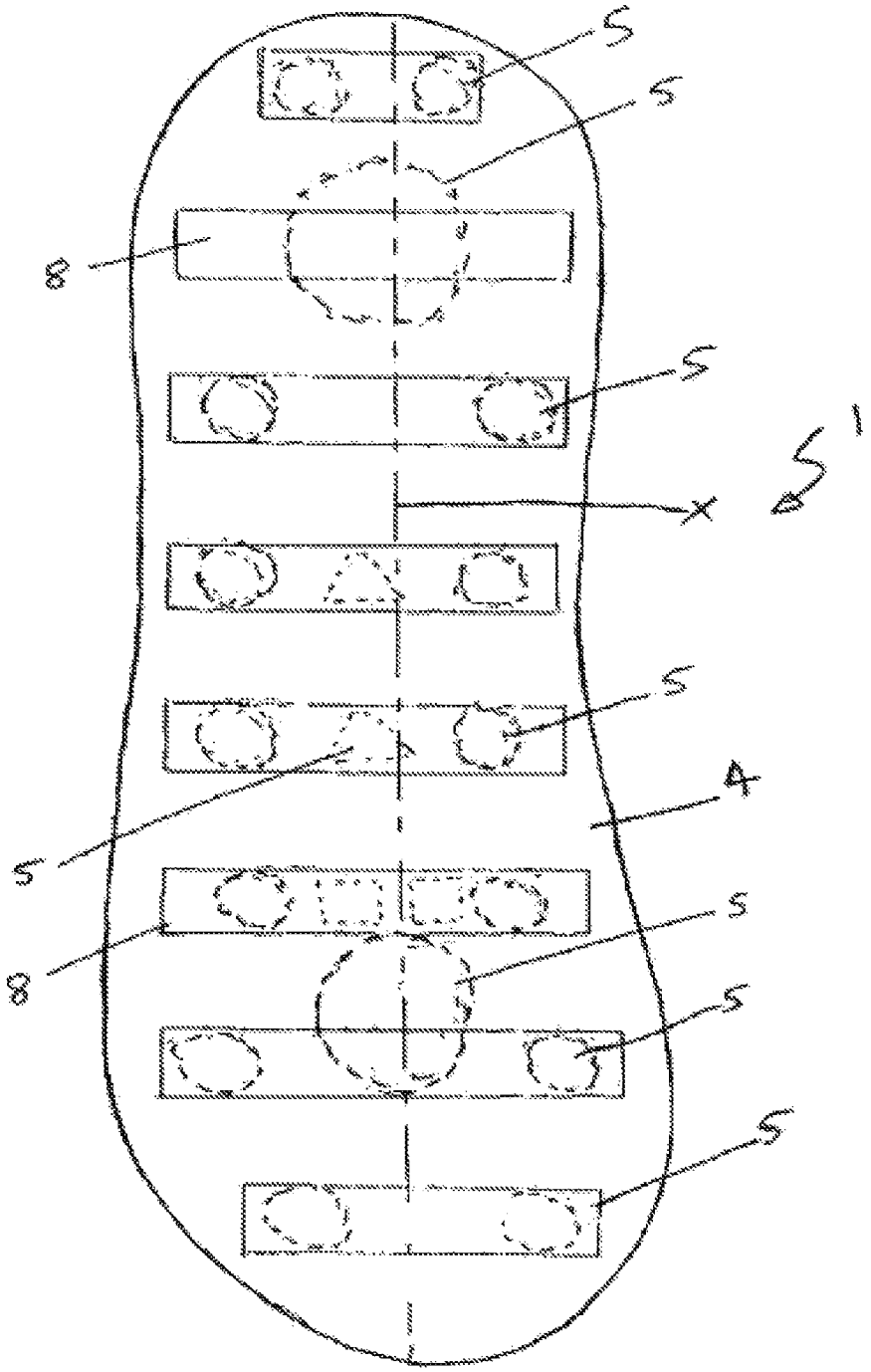
FIG. 2 is a bottom view of the footwear of FIG. 1.

In a preferred form, the magnets 5 are embedded in the midsole 3 in the apertures 8. The magnets 5 can be secured in the footwear 1 by any typical fastening means, such as, by use of an adhesive, moulding, snap-fit, interference fit, or the like. In a preferred form, the magnets 5 are located 2 to 10 mm from the second surface 7 and more preferably 2 to 4 mm from the second surface 7. The magnets 5 can be of any shape and in particular rectangular or circular. As best seen in FIG. 2, the magnets 5 are equally spaced apart along a length X of the footwear 1. The magnets 5 can be aligned in a series of spaced rows along the longitudinal length X and can have a distance between the rows of about 10 to 15 mm. However, it should be appreciated that the magnets 5 can be located in any pattern that provides suitable grip.

The present invention at least in a preferred form provides footwear 1 having magnets 5 for use in particular in the construction industry and for use on metal rooves, scaffold or the like. However, it should be appreciated that footwear 1 could also be used on any metallic surface, such as, for skateboarding, bike riding, water skiing, trains, trucks, boats, containers, oil rigs, or the like. Footwear 1 will provide better traction for a user to a metal surface than existing footwear. Safety issues within the construction industry are very important and the footwear 1 is envisaged to provide further security for workers when working at heights and in particular on a roof.

The footwear 1 could also be used on any such surface, for example, on aeroplane wings, trucks, stairs, containers or the like. The magnets 5 should be of sufficient strength to provide a gripping force to resist a user falling from an object or structure and could be tailored to a person's height or weight. The footwear 1 would be a sufficient advantage to a roof worker where the roof is pitched at a considerable angle and the roof material is metal. The footwear 1 could include a range of different size and strength magnets to allow more interchangeability depending upon the surface on which the user is working. It is also envisaged that the apertures 8 are arranged in such a way that the user can arrange the magnets 5 in a particular configuration to suit the work environment.

A second embodiment of footwear 100 according to the invention is depicted in FIGS. 3A to 6D. In this embodiment the foot wear includes magnets 105 which are generally circular in profile when viewed from the top or bottom.

Figure 8:
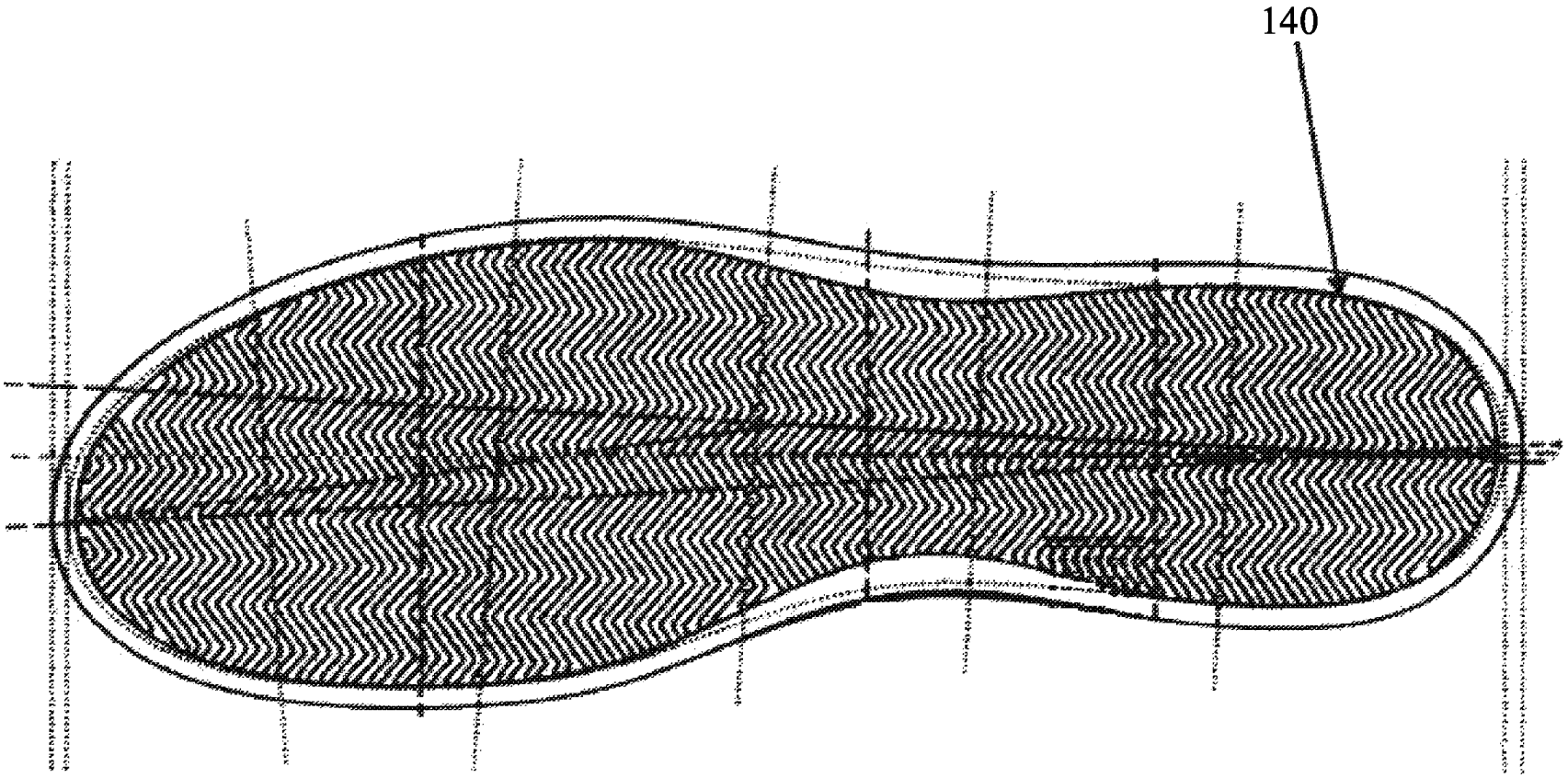
FIG. 8 depicts a tread pattern of the footwear according to either of the first or second embodiments.

The grip pattern of the sole of the footwear 101 is depicted in FIG. 8 and includes rows of V-shaped waves or undulations 140.

Figures 3A, 3B, 3C:
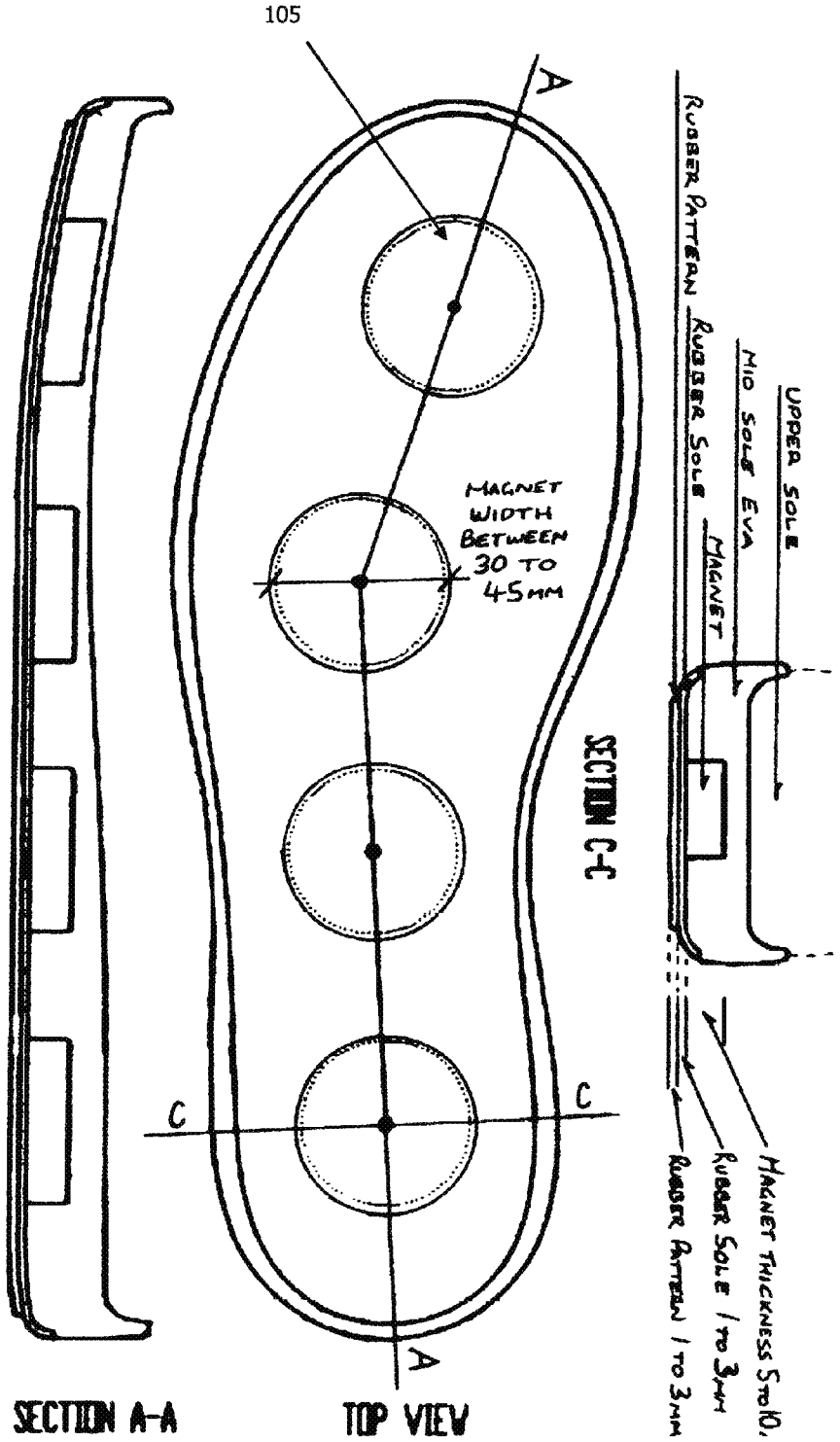
FIG. 3A depicts a top view of a footwear sole according to a second embodiment.
FIG. 3C depicts an end view of the footwear sole of FIG. 3A, taken along line C-C.
Figure 3D:
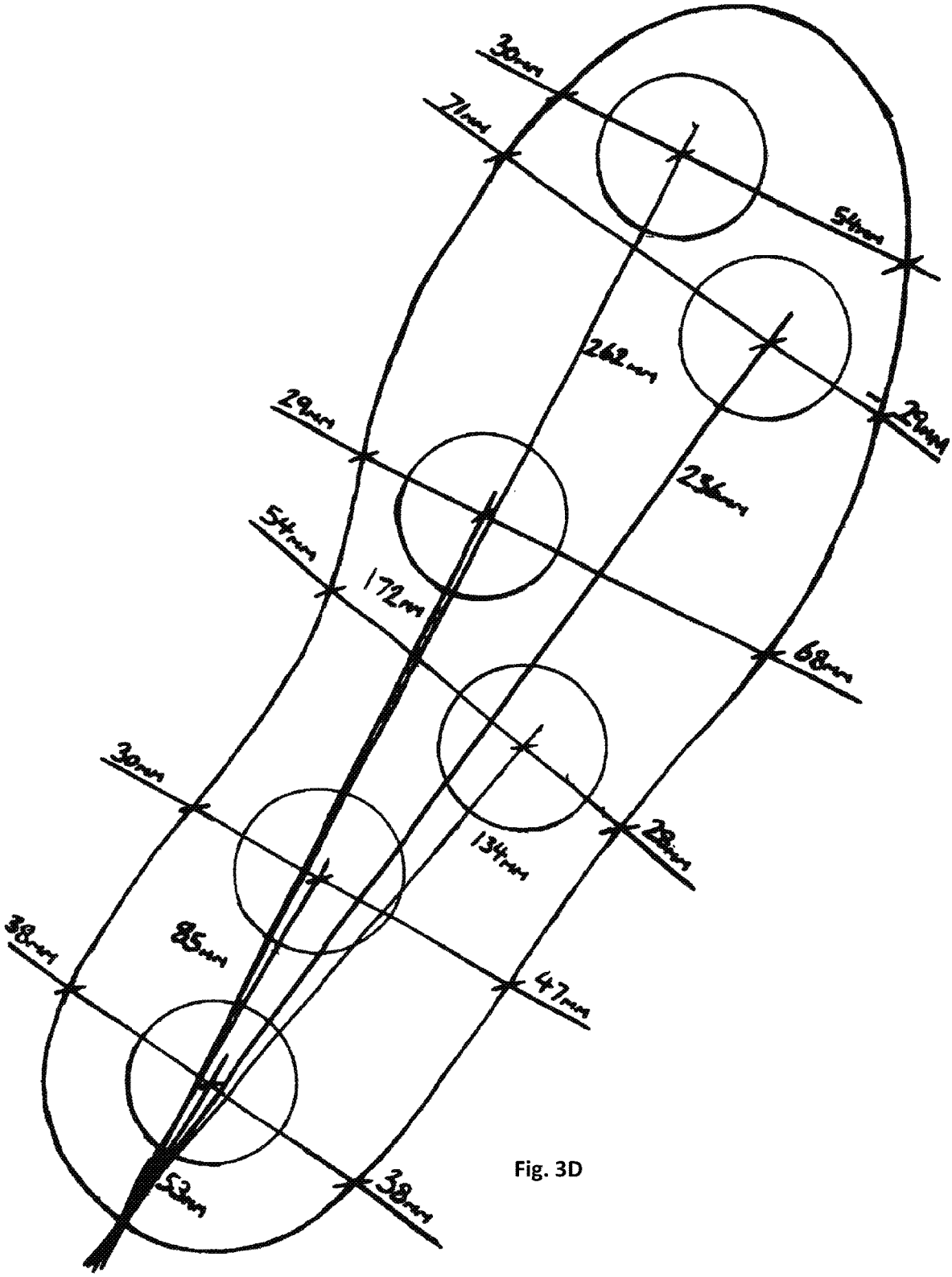
FIG. 3D depicts a variation of the footwear sole of FIG. 3A.

As shown in FIG. 3A, there are four magnets 105. The first three magnets 105 are generally arranged in a linear formation, starting from the heel of the shoe, and extending toward the front of the shoe. The magnets are preferably between 30 mm to 45 mm in diameter. Referring again to FIG. 3A, the forward most of the four magnets 105 is located around the ball of the wearer's foot, and diverges inwardly (toward the direction of the wearer's big toe) relative to the line on which the other three magnets are positioned. In this manner, the magnets 105 are positioned to correspond generally with the weight bearing structures of the wearer's foot.

Figure 4:
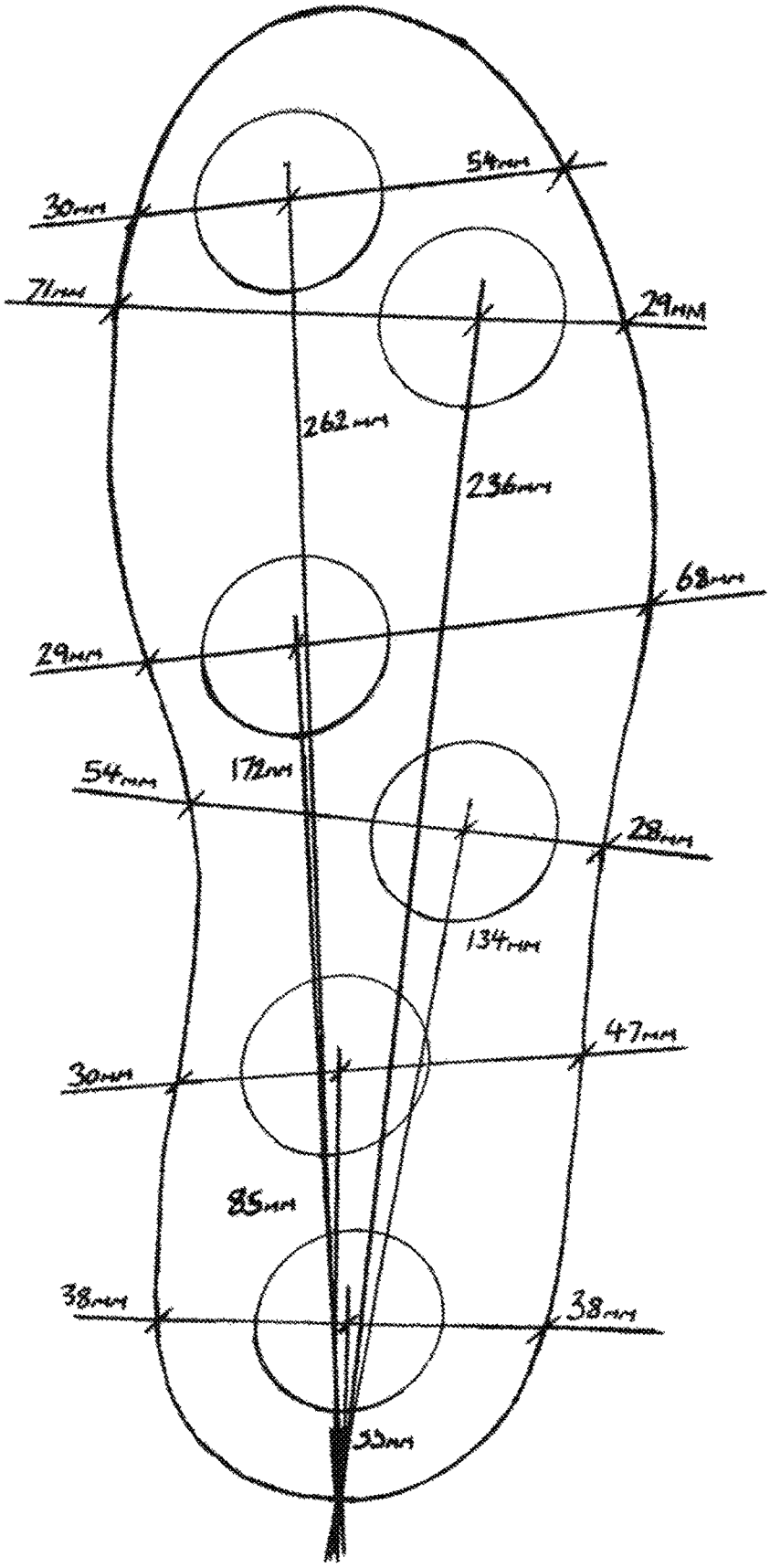
FIG. 4 depicts a further variation of the footwear sole of FIG. 3A.
Figure 5:
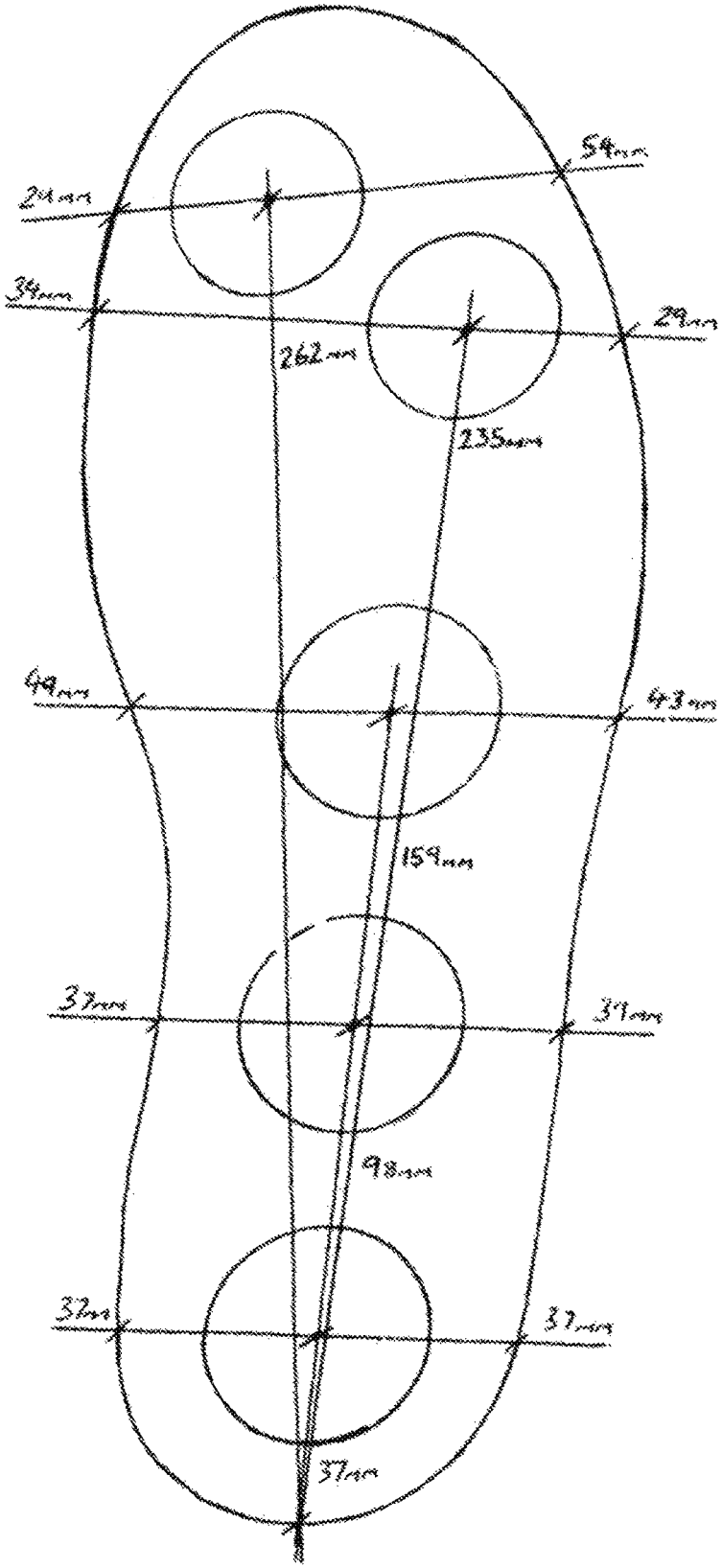
FIG. 5 depicts a further variation of the footwear sole of FIG. 3.

An alternative embodiment is shown in FIG. 4. This embodiment is similar to the embodiment of FIG. 3A, with the inclusion of an additional fifth magnet 105 at the ball of the foot. During normal walking, it is common that at one stage of the gait, the toes and ball of the foot are still generally flat on the walking surface, while the heel and midfoot are already raised. This generally corresponds to the end of the step, in respect of the rear foot, just prior to the rear foot leaving the ground surface. By including two magnets 105 at the front portion of the footwear 101, an additional anti-slip force can be generated, preventing the wearer from slipping.

The footwear of FIG. 4 applies a larger force than the footwear of FIG. 3A if the same magnets are used. This way, the footwear 101 may be provided with different magnet force to suit user's weight.

Each of the magnets 105 is located in a metal housing 120 which is between about 0.5 mm and 2 mm thick. The housing 120 is fabricated from a ferrous metal such as steel. The housings 120 can be seen schematically in broken line in FIG. 6A. Each housing 120 is fabricated with a generally planar base 121 and a cylindrical wall portion 122. As such, each housing 120 defines a receptacle which is open on one side, and is sized to receive one of the magnets 105. When a magnet 105 is seated in the receptacle of the housing 120, the exposed surface of the magnet 105 is approximately in alignment with the end portion of the cylindrical wall portion 122.

The apertures 108 which are formed in the midsole 103 are circular and are sized to neatly receive one of the metal housings 120, and the housing 120 may be bonded into the aperture 108 with an adhesive. Each metal housing serves several purposes. Firstly, it has the effect of limiting the magnet 105 attraction or repulsion force in all directions except facing downwardly, toward the outsole 104.

Secondly, during assembly, the metal housings 120 assist to deactivate some of the magnetic force, and this reduces the tendency for the magnets 105 to pop out of the apertures 108, and be attracted to the adjacent magnets 105. This is important as the magnetic force can be dangerous for the workers during footwear 101 assembly, as the magnetic force can cause significant injuries, for example if a finger is caught between two of the magnets 105.

Figure 7:
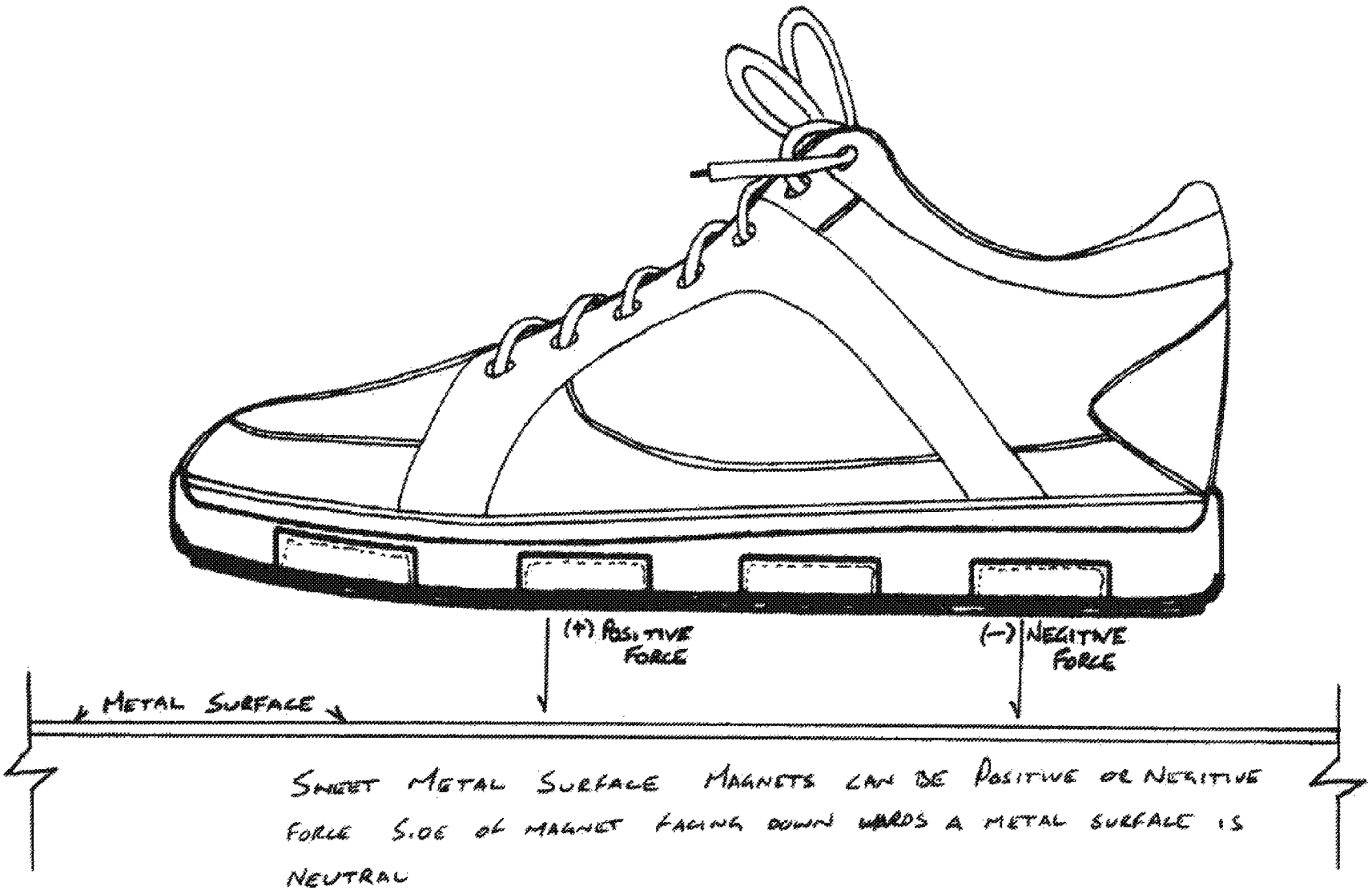

As depicted in FIG. 7, magnets may be assembled in the sole with either a positive or negative force facing out towards the metallic surface the footwear will be in contact with. The nature of magnet force dictates that either the positive or negative pole of each magnet 105 will be drawn to a ferrous metal, such as corrugated metal roofing. However, the magnets 105 are all installed in the apertures 108 in the midsole 103 with the polarity facing the same direction. That is, all negatives facing down or all positives facing down. This is done so the outsole 104 of the footwear 101 can be cleaned, as discussed below.

Figures 6A, 6B, 6C:
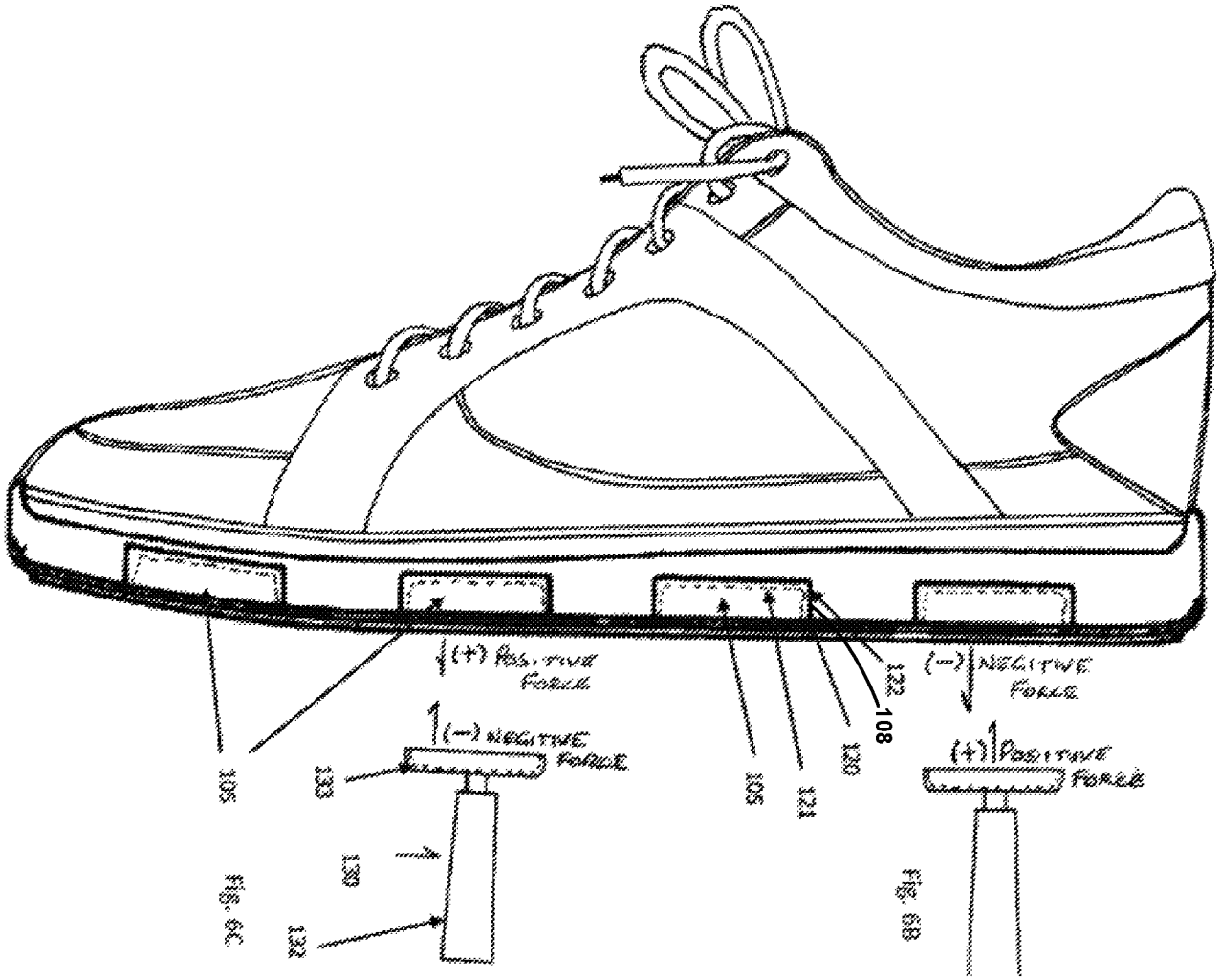
FIG. 6A shows the footwear of the second embodiment.
FIGS. 6B and 6C show an embodiment of a cleaning tool for use with the footwear according to the first or second embodiments.
Figure 6D:
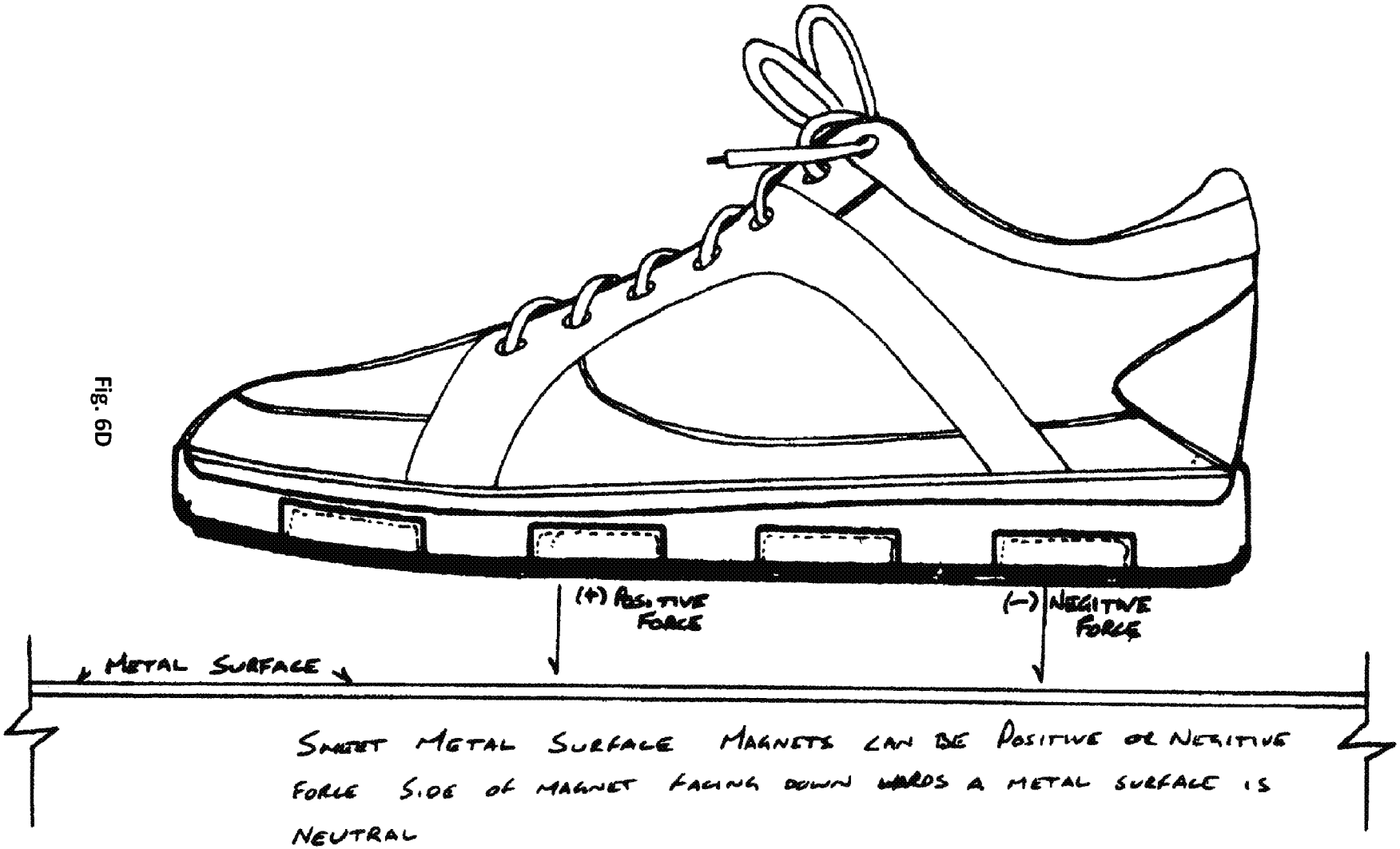

A cleaning tool 130 is provided, as shown in FIGS. 6B-6C. The cleaning tool 130 has a handle 132 and a cup 133, which is similar to the metal housing 120. The cup 133 is fitted with a magnet 105, and the magnet 105 is orientated so that its outward facing magnetic polarity is the opposite to the underside of the footwear 101, that is, so that the cleaning tool 130 is attracted to the outsole 104.

During use, when a wearer is working on a roof, it is very common that the user's footwear 101 will attract metallic swarf resulting from drilling and grinding processes on the roof. By placing the cleaning tool against the outsole 104, the two magnets 105 will be attracted to each other, and the outsole 104 and swarf will be sandwiched between the two magnets 105. However, the magnet 105 of the cleaning tool 130 is closer to the swarf, and hence will generate a larger attraction force than the magnet 105 within the footwear 101. As such, the swarf will transfer to the cleaning tool 130, and the user can easily scrape the swarf away from the cleaning tool 130 at that time, or at a later stage as desired.

Advantageously, the cleaning tool overcomes the problem of the footwear 101 becoming covered with metallic swarf which may decrease the efficiency of the footwear 101 over time.

In addition, without the cleaning tool 130, the swarf can be difficult to remove from the tread of the footwear 101.

The thickness of the outsole 104 along with any grip on the outsole 104 has a direct influence on the magnetic force, due to the separation between the magnets 105 and the roof surface. Preferably the thickness of the outsole 104 is between 1 mm and 3 mm, and the pattern of the rubber is between 1 mm and 3 mm.

The midsole 103 thickness is determined by the thickness and radius of the magnets 105.

Different magnets 105 may be utilised in the footwear 101, including rare earth, neodymium, iron boron, ceramic, ferrite, pot and samarium cobalt.

The magnets 105 are typically fabricated with an individual holding power of between 25 kg to 80 kg. The magnets are between 30 and 40 mm in diameter, and have a thickness between about 6 mm and 10 mm. The magnets 105 have a magnetisation of between N35 and N52, and are designed to operate at temperatures of up to 80 degrees Celsius. The magnets 105 are preferably nickel plated.

Advantageously, the footwear 101 is designed for use on all ferrous metal surfaces and profiles such as corrugated and flat steel profiles. The footwear 101 operates as normal shoes on other non-ferrous surfaces.

Advantageously, the outsole 104 separates the magnets 105 from the metal surface, thereby protecting the surface from being scratched or damaged by the magnets 105.

Advantageously the footwear 101 may have one or more straps to assist the foot from not moving within the footwear 101. The footwear 101 may be provided with a high cut style for increased ankle support. Alternatively, the footwear 101 may be low-cut for increased flexibility.

The footwear 101 may accommodate innersoles to assist with user specific conditions such as arch support, movement within the footwear 101, user weight and custom orthotics.

Although the invention has been described with reference to specific examples, it will be appreciated by those skilled in the art that the invention may be embodied in many other forms.

The claims defining the invention are as follows:

1. Footwear having:

a vamp;

an insole;

an outsole; and a midsole including a first surface adjacent to the insole, a second surface adjacent to the outsole, and a first aperture extending inwardly from the second surface towards the first surface;

wherein the first aperture comprises a first ferrous metal housing that defines a first receptacle which is open on one side, wherein a first magnet is disposed within the first receptacle such that a surface of the first magnet is exposed from the first ferrous metal housing so as to be faced towards, and to be adjacent to the outsole, and wherein the outsole extends across the footwear, covering a majority of the second surface of the midsole so as to encapsulate the first ferrous metal housing and the first magnet between the midsole and the outsole so that, in use, the first magnet provides a gripping force between the footwear and a ferrous metallic surface when the footwear is placed on the ferrous metallic surface, due at least in part to the outsole creating separation between the first magnet and the ferrous metallic surface.

2. The footwear of claim 1, further comprising a second, a third, and a fourth magnet that are each disposed within a respective second, third and fourth receptacle formed by a second, third and fourth ferrous metal housing, with the outsole extending completely over an open side of the second, third and fourth receptacle so as to encapsulate the second, third and fourth ferrous metal housing and the second, third and fourth magnet, and wherein the first second, third, and fourth magnets each have a holding power of between 25 kg and about 85 kg.

3. The footwear of claim 2, wherein the first, second, third, and fourth magnets each have their polarities facing in substantially a same direction ferrous metal.

4. The footwear of claim 3, wherein the first magnet is disposed in a ball portion of the footwear, and wherein the second magnet is disposed in a heel portion of the footwear.

5. The footwear of claim 2, further comprising a cleaning tool, the cleaning tool having a handle connected to a cup, the cup holding a cleaning tool magnet having a polarity which is opposed to a polarity of the first magnet, such that the cleaning tool is attracted to the first magnet of the footwear, and wherein the cleaning tool magnet provides a stronger magnetic pull to ferrous debris collected on a tread of the outsole than does the first magnet when the cleaning tool magnet is placed against the tread of the outsole that comprises the ferrous debris.

6. The footwear of claim 1, wherein the surface of the first magnet is embedded between the midsole and the outsole by between 1 mm and about 6 mm from a tread of the outsole.

7. The footwear of claim 6, wherein the surface of the first magnet is configured to be embedded between the midsole and the outsole by between 1 mm and about 6 mm away from the ferrous metallic surface when the tread of the outsole rests on the ferrous metallic surface and when the ferrous metallic surface is substantially planar.

8. The foot wear of claim 1, further comprising a second ferrous metal housing having a second magnet disposed therein, wherein the first ferrous metal housing and the first magnet are disposed in a ball portion of the footwear, wherein the second ferrous metal housing and the second magnet are disposed in a heel portion of the footwear, and wherein the first and second magnets each have an individual holding power of greater than about 25 kg.

9. The footwear of claim 8, wherein the first ferrous metal housing comprising the first magnet and the second ferrous metal housing comprising the second magnet, which each have individual holding power greater than 25 kg.

10. The footwear of claim 8, wherein the first and second magnets each have a polarity facing in a substantially similar direction.

11. Footwear having:

a vamp;

an outsole; and a midsole including a first surface that faces towards the vamp and a second surface that is adjacent to and faces towards the outsole, wherein the second surface defines a first aperture and a second aperture that each extend inwardly from the second surface towards the first surface, wherein the first and second apertures respectively comprise a first and a second ferrous metal housing, wherein the first and second ferrous metal housings respectively define a first receptacle and a second receptacle, which are each open on one side, wherein a first and a second magnet are respectively disposed within the first and the second receptacle, wherein the first ferrous metal housing and the first magnet are disposed at a heel portion of the footwear, and wherein the outsole extends across the footwear, covering a majority of the second surface of the midsole so as to enclose the first and second magnets between the midsole and the outsole so that, in use, the first and second magnets each provide a gripping force between the footwear and a ferrous metallic surface when a tread of the outsole is placed on the ferrous metallic surface, due at least in part to the outsole creating separation between the first and second magnet and the ferrous metallic surface.

12. The footwear of claim 11, further comprising a third aperture defined by the second surface, the third aperture extending inwardly from the second surface towards the first surface, the third aperture comprising a third ferrous metal housing, wherein the third ferrous metal housing defines a third receptacle, which is open on one side, wherein a third magnet is disposed within the third receptacle, and wherein the outsole extends to enclose the third magnet between the midsole and the outsole.

13. The footwear of claim 11, wherein the first and second magnets each have an individual holding power of between 25 kg and about 80 kg.

14. The footwear of claim 13, wherein a polarity of the first magnet faces in substantially a same direction as a polarity of the second magnet, and wherein the second magnet is disposed in a ball portion of the footwear.

15. The footwear of claim 11, wherein a surface of the first magnet that is exposed from the open side of the first receptacle, and is embedded between the midsole and the outsole between 1 mm and about 6 mm from the tread of the outsole.

16. A combination of a footwear and a magnetic cleaning tool, the combination having:

footwear comprising:

a vamp;

an outsole; and a midsole including:

a first surface that faces towards the vamp;

a second surface that is adjacent to and that faces the outsole; and a first recess extending inwardly from the second surface towards the first surface, wherein the first recess comprises a first ferrous metal housing, wherein the first ferrous metal housing defines a first receptacle which is open on one side, with a first magnet being disposed within the first receptacle, and wherein the outsole extends across the footwear, covering a majority of the second surface of the midsole so as to encapsulate the first ferrous metal housing and the first magnet between the midsole and the outsole; and a magnetic cleaning tool, wherein the magnetic cleaning tool comprises a first cleaning magnet that provides a stronger magnetic pull to ferrous debris that is collected on a tread of the outsole than does the first magnet when the cleaning tool magnet is placed against the tread of the outsole that comprises the ferrous debris.

17. The combination of claim 16, further comprising a second recess extending inwardly from the second surface towards the first surface, wherein the second recess comprises a second ferrous metal housing, wherein the second ferrous metal housing defines a second receptacle which is open on one side, with a second magnet being disposed within the second receptacle, wherein the outsole extends to encapsulate the second ferrous metal housing and the second magnet between the midsole and the outsole, wherein the first ferrous metal housing and the first magnet are disposed at a toe end portion of the footwear and the second ferrous metal housing and the second magnet are disposed at a heel-end-portion of the footwear, and wherein the first and second magnets each have an individual holding power of between 25 kg and about 80 kg.

18. The combination of claim 17, wherein the first and second magnets each have a polarity that faces in a substantially similar direction.

19. The combination of claim 17, further comprising a third and fourth recess extending inwardly from the second surface towards the first surface, wherein the third and fourth recess respectively comprise a third and fourth ferrous metal housing, wherein the third and fourth ferrous metal housing respectively define a third and fourth receptacle which are each open on one side, with a third and fourth magnet being respectively disposed within the third and fourth receptacle, and wherein the outsole extends to encapsulate the third and fourth ferrous metal housing and the third and fourth magnet between the midsole and the outsole, wherein the third and fourth magnet each have a holding power of between 25 kg and 80 kg, and wherein the first, second, third, and fourth magnets each have a polarity that faces in a substantially similar direction.

20. The combination of claim 16, wherein a surface of the first magnet that is exposed from the open side of the first receptacle, and is embedded between the midsole and the outsole by between 1 mm and about 6 mm from the tread of the outsole.

* * * * *